US011208862B2

(12) United States Patent
Maher

(10) Patent No.: US 11,208,862 B2
(45) Date of Patent: Dec. 28, 2021

(54) METHOD OF DRILLING AND COMPLETING A WELL

(71) Applicant: James V. Maher, Houston, TX (US)

(72) Inventor: James V. Maher, Houston, TX (US)

(73) Assignee: Trendsetter Vulcan Offshore, Inc., Houston, TX (US)

( * ) Notice: Subject to any disclaimer, the term of this patent is extended or adjusted under 35 U.S.C. 154(b) by 373 days.

(21) Appl. No.: 15/993,162

(22) Filed: May 30, 2018

(65) Prior Publication Data

US 2019/0368300 A1 Dec. 5, 2019
US 2020/0325747 A9 Oct. 15, 2020

Related U.S. Application Data

(60) Provisional application No. 62/512,585, filed on May 30, 2017.

(51) Int. Cl.
*E21B 33/064* (2006.01)

(52) U.S. Cl.
CPC ..... *E21B 33/064* (2013.01)

(58) Field of Classification Search
CPC ..... E21B 17/01; E21B 33/035; E21B 33/043; E21B 33/064; E21B 33/076
See application file for complete search history.

(56) References Cited

U.S. PATENT DOCUMENTS 3,179,179 A * 4/1965 Kofahl ..... E21B 7/128 166/352
3,603,385 A * 9/1971 Jones ..... E21B 33/035 166/336
3,695,364 A 10/1972 Porter et al.
4,444,404 A 4/1984 Parks et al.
5,253,713 A 10/1993 Gregg et al.
5,474,334 A 12/1995 Eppink et al.
5,634,671 A 6/1997 Watkins et al.
5,706,897 A * 1/1998 Horton, III ..... E21B 15/02 166/359
6,089,526 A 7/2000 Olson et al.
6,260,625 B1 7/2001 Phan et al.
7,021,402 B2 4/2006 Beato et al.
7,056,027 B2 6/2006 Puckett et al.
7,073,593 B2 * 7/2006 Hatton ..... E21B 7/128 166/345
8,176,985 B2 * 5/2012 Humphreys ..... E21B 19/002 166/358
8,181,704 B2 5/2012 Fenton et al.
8,579,034 B2 11/2013 Berner et al.
9,200,493 B1 12/2015 Lugo et al.
2003/0051879 A1 * 3/2003 Azancot ..... E21B 33/038 166/350

(Continued)

FOREIGN PATENT DOCUMENTS

WO 2007103707 9/2007
WO WO-2007103707 A2 * 9/2007 ..... E21B 17/01
WO 2015147649 10/2015

*Primary Examiner* — James G Sayre
(74) *Attorney, Agent, or Firm* — Jonathan Pierce; Pierre Campanac; Porter Hedges LLP

(57) ABSTRACT

For completing a well, and for performing workover or intervention operations with the well, a surface BOP stack is coupled to the subsea wellhead or a subsea tree via a high pressure riser. The well is completed or the workover or intervention operations are performed through the surface BOP stack.

3 Claims, 4 Drawing Sheets

(56) References Cited

U.S. PATENT DOCUMENTS

| | | | | |
|---|---|---|---|---|
| 2004/0140124 | A1* | 7/2004 | Fenton | B01D 17/0211 175/7 |
| 2004/0256096 | A1 | 12/2004 | Adams et al. | |
| 2005/0028980 | A1* | 2/2005 | Page | E21B 33/1294 166/285 |
| 2005/0269096 | A1 | 12/2005 | Milberger et al. | |
| 2006/0042791 | A1 | 3/2006 | Hosie et al. | |
| 2007/0252387 | A1 | 11/2007 | Beard et al. | |
| 2008/0031692 | A1 | 2/2008 | Wybro et al. | |
| 2008/0271896 | A1 | 11/2008 | Inderberg et al. | |
| 2011/0109081 | A1* | 5/2011 | Baugh | E21B 17/012 285/148.28 |
| 2011/0127040 | A1* | 6/2011 | Humphreys | E21B 17/017 166/345 |
| 2013/0299178 | A1 | 11/2013 | DeBerry et al. | |
| 2015/0144356 | A1 | 5/2015 | DeOcampo et al. | |
| 2017/0101829 | A1 | 4/2017 | Heide et al. | |
| 2017/0144356 | A1 | 5/2017 | Lisch, Jr. et al. | |

* cited by examiner

METHOD OF DRILLING AND COMPLETING A WELL

CROSS-REFERENCE TO RELATED APPLICATIONS

This application claims priority to U.S. provisional application Ser. No. 62/512,585 filed on May 30, 2017, and entitled "Method of Drilling and Completing a Well." The priority application is incorporated herein by reference.

BACKGROUND

This disclosure relates generally to methods for drilling and completing subsea hydrocarbon wells.

As deepwater hydrocarbon wells are being drilled in environments with high pressures and temperatures, conventional drilling and completion equipment and methods often prove ineffective or uneconomical. For example, a subsea drilling system rated at 20,000 psi, a completion workover riser coupled to a test tree rated at 20,000 psi, a landing string including a shear joint or other means and/or dual redundant isolation valves rated at 20,000 psi are often required.

Thus, there is a continuing need in the art for equipment and methods to economically drill and complete high-pressure wells in deep water environments.

SUMMARY

In one aspect, the disclosure describes a method for completing a well. The method may comprise the step of removing a conventional blowout preventer (BOP) stack from the subsea wellhead after construction of a wellbore below the subsea wellhead. The method may further comprise the step of coupling a surface BOP stack to the subsea wellhead via a high pressure riser. The method may further comprise the step of completing the well through the surface BOP stack. The method may further comprise the step of coupling a mudline closure device between the subsea wellhead and the high pressure riser.

In one aspect, the disclosure describes a method for workover or intervention operations with a well. The method may comprise the step of coupling a surface BOP stack to a subsea tree via a high pressure riser. The method may further comprise the step of performing the workover or intervention operations through the surface BOP stack. The method may further comprise the step of coupling a mudline closure device between the subsea wellhead and the high pressure riser.

In one aspect, the disclosure describes a method a method for constructing and completing a well. The method may comprise the step of coupling a conventional BOP stack to a subsea wellhead via a conventional riser. The method may further comprise the step of drilling a wellbore through the conventional BOP stack and conventional riser. The method may further comprise the step of casing the wellbore through the conventional BOP stack and conventional riser. The method may further comprise the step of removing the conventional BOP stack from the subsea wellhead. The method may further comprise the step of coupling a surface BOP stack to the subsea wellhead via a high pressure riser. The method may further comprise the step of completing the well through the surface BOP stack. The method may further comprise the step of coupling a mudline closure device between the subsea wellhead and the high pressure riser.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
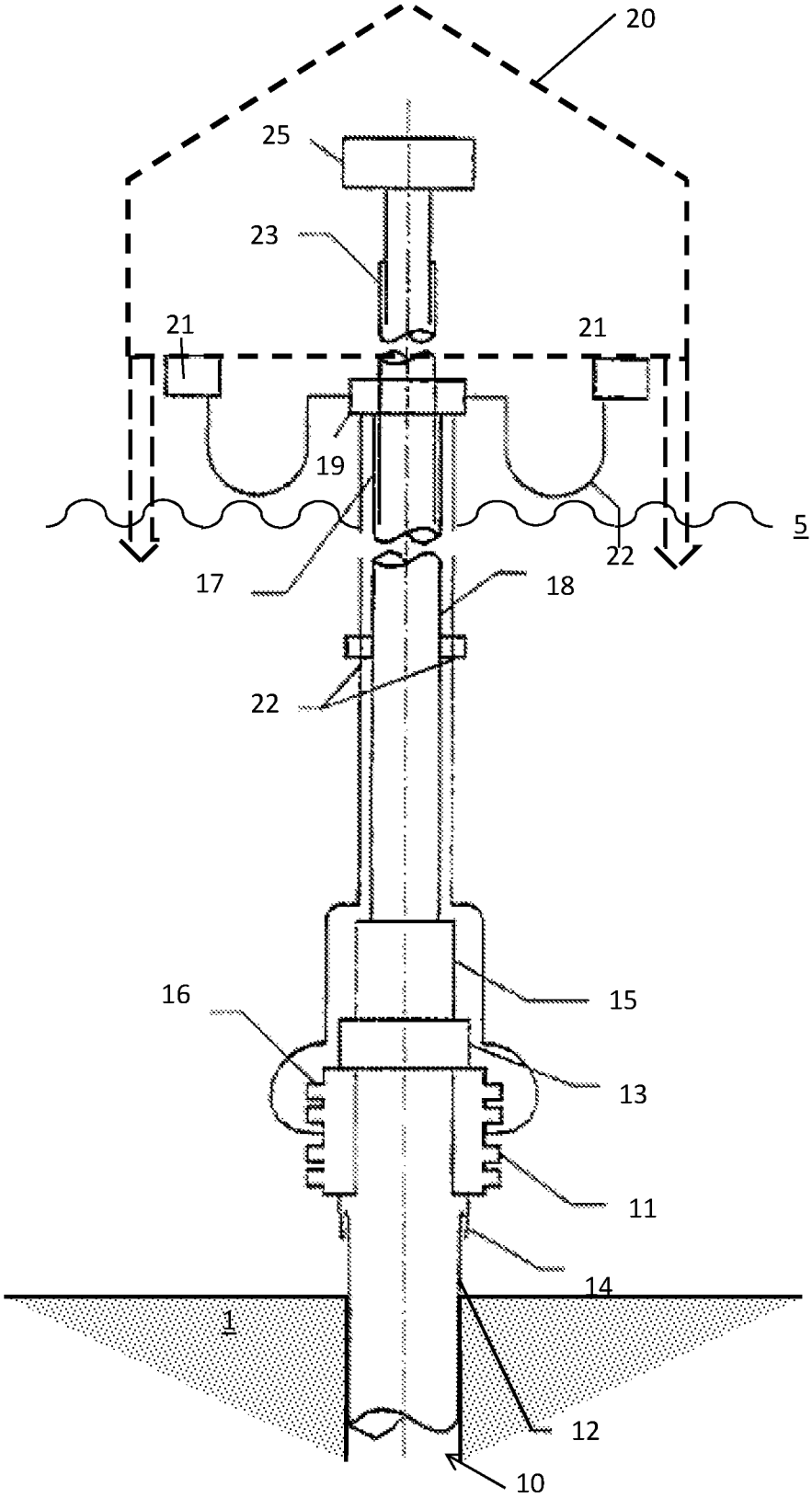
FIG. 1 is a partial schematic view of a conventional BOP stack and conventional riser deployed on a subsea wellhead for drilling operations.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

As used herein, High Pressure is defined as pressure at or above 15,000 psi pressure. High Temperature is defined as temperature at or above 350 degrees F.

As used herein, BOP stack is a blowout preventer stack, which may include one or more of a ram blowout preventer, an annular blowout preventer, and, when used during drilling, a lower marine riser package (LMRP).

As used herein, a Conventional BOP stack refers to a subsea blowout preventer stack assembly rated for operation with wellbore pressures below 15,000 psi.

As used herein, a Conventional Riser refers to a riser string that connects a Conventional BOP stack to a surface drilling unit. The Conventional Riser is not designed for containing full wellbore pressures and must therefore be protected at all phases of the life of the well by other equipment, including but not limited to, a subsea BOP, a high pressure landing string, and/or dual redundant isolation valves such as commonly used in subsea test trees.

As used herein, a High Pressure Surface BOP stack, or Surface BOP stack, refers to a blowout preventer stack that is rated for operation with wellbore pressures at or above 15,000 psi and, during operations, is disposed on surface drilling unit. Note that some components are designed based on internal pressure at or above 15,000 psi and others components are designed according to differential pressure occurring when internal pressure equal to or larger than 15,000 psi. Note also that the High Pressure rating is based on wellbore pressures, and that in many High Pressure operations, the surface pressure does not exceed 15,000 psi.

As used herein, a High Pressure Riser refers to a riser string that connects a High Pressure Surface BOP stack to a subsea wellhead. The High Pressure Riser is designed for containing full wellbore pressure and therefore does not need to be protected during any phase of the life of the well.

As used herein, a primary barrier consists of equipment for pressure containment and control that is critical.

As used herein, a secondary barrier consists of equipment for pressure containment and control that is not critical.

Wellbore construction generally includes both a drilling phase and a completion phase. During the drilling phase, the wellbore is drilled to a specified depth and lined with a series of casing strings that isolate the interior of the wellbore from the surrounding formation. Once the wellbore is drilled and cased to a desired depth, the completion phase can begin. During the completion phase, additional downhole tubulars and flow control devices are installed into the wellbore to enable the safe and efficient production of hydrocarbons from the surrounding formation. In general, during the construction phase, high pressure formation fluids are prevented from entering the wellbore, either by the casing or by hydrostatic pressure created by the column of drilling fluid filling the wellbore and riser. During, and after, the completion phase, the wellbore, or at least a portion thereof, is exposed to high pressure formation fluids.

Because the drilling and completion phases of well construction differ in what pressures, temperature, and types of fluids that will be encountered, the practical considerations and regulations that apply to each phase are significantly different. For example, during the drilling phase wellbore pressure can often be limited to pressures below 15,000 psi at the wellhead but, in contrast, once the completion phase begins, the same wellbore may be exposed to pressures at or above 15,000 psi at surface.

The disclosure describes equipment and methods to economically drill and complete high-pressure wells in deep water environments. The equipment and methods described herein allow High Pressure drilling, completion, and intervention work, and optionally High Pressure and High Temperature drilling, completion, and intervention work, to be done using conventional equipment, as well as a system including a High Pressure Surface BOP, a High Pressure Riser System, and a mudline closure device (MCD). The equipment described in this disclosure is rated at or above 15,000 psi but is not necessarily rated beyond conventional temperatures (i.e., the equipment may not be rated for temperatures above 350 deg. F.). The High Pressure Riser may allow simplification of the design of the landing string used during completion, while providing an increased level of safety.

Referring initially to FIG. 1, a schematic view of a well 10 drilled through the seafloor 1 is illustrated during the construction phase, including drilling of the well 10, casing portions of the well 10 and/or lining portions of the well 10 and providing a tie-back from the liner to the casing.

Well 10 includes a subsea wellhead 12. A Conventional BOP stack 16 is coupled to the wellhead by BOP connector 14. The Conventional BOP stack 16 may include a ram BOP 11, an LMRP 13, and an annular BOP 15. The LMRP 13 may form a section of a multi-section subsea BOP stack. The annular BOP 15 may form a portion of the LMRP 13. In addition, the LMRP 13 may include a hydraulic connector, jumper hoses for the choke, kill and auxiliary lines, and subsea control pods. A Conventional Riser 18, including flex joint and riser adapter, is coupled to the Conventional BOP stack 16 and extends to a drilling rig 20 above the sea surface 5. For example, the Conventional riser 18 may be suspended via a tension ring 19 from the drilling rig 20. An upper telescopic joint 23 and lower telescopic joint 17 may be used to allow heave compensation between a diverter 25 mounted on the drilling rig 20 and the tension ring 19. Choke and kill lines 22 also extend from the Conventional BOP stack 16 to the drilling rig 20 along the Conventional Riser 18. Choke and kill lines 22 are connected to the choke and kill manifold 21.

During the construction phase, the subsea wellhead 12, ram BOP 11, choke and kill lines 22, and choke and kill manifold 21 may form a primary barrier against high pressure blowouts of formation fluid. The equipment forming the primary barrier is usually designed according to standards for containing pressure blowouts up to a rating of 15,000 psi, and to be operable even in the presence of a drill string. However, the LMRP 13 including the annular BOP 15, the Conventional Riser 18, and the lower telescopic joint 17 may form a secondary barrier against blowouts.

Note that because the maximum pressure caused by blowouts is usually below 15,000 psi before the production tubing is run, the equipment illustrated in FIG. 1 may be classified as conventional (e.g., non-High Pressure High Temperature) equipment.

Figure 2:
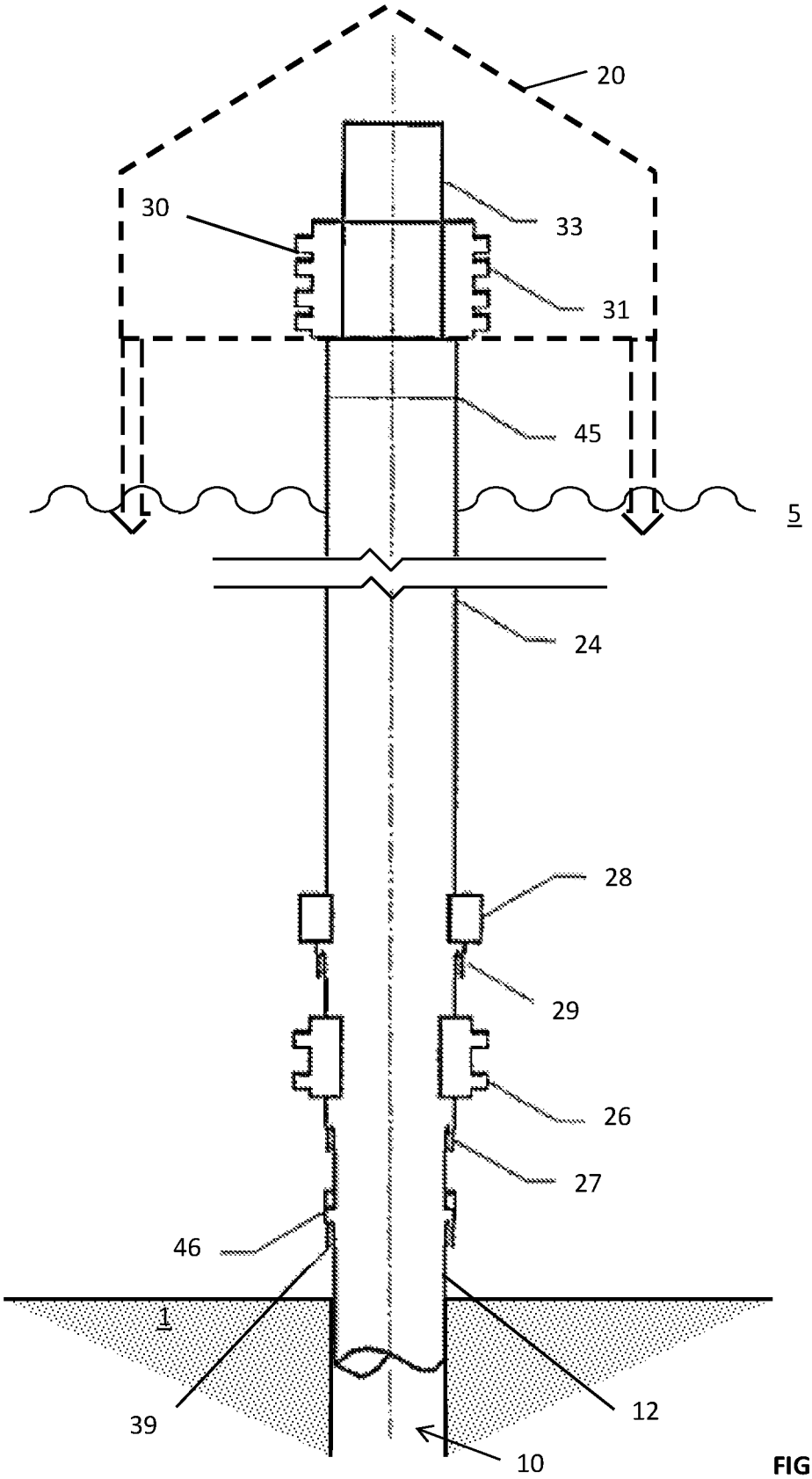
FIG. 2 is a partial schematic view of a surface BOP stack and a high pressure riser deployed on a subsea wellhead for lower completion operations.

Once the drilling phase is complete, the Conventional BOP stack 16 is disconnected from the subsea wellhead 12 and retrieved to the surface. Referring now to FIG. 2, to begin the lower completion phase, a High Pressure Riser 24 is coupled to the subsea wellhead 12 via a tubing head 46, a MCD 26 and emergency disconnect package (EDP) 28. The EDP 28 is connected on top of the MCD 26 by EDP connector 29. The MCD 26 is connected on top of the tubing head 46 by MCD connector 27. The MCD 26 can provide two additional sets of rams with an independent control system, an acoustic control, and communications system, hydraulic flying leads, a remotely operated vehicle (ROV) control panel, and a subsea accumulator module. The MCD is preferably rated for containing a pressure equal to 20,000 psi. The tubing head 46 is directly connected to the subsea wellhead 12 by tubing head connector 39. The High Pressure Riser 24 extends a surface connector 45 where it is coupled to the drilling rig 20. The surface connector 45 is coupled to a Surface BOP stack 30. The surface BOP stack 30 includes a surface ram BOP 31 and a surface annular BOP 33. The configuration shown in FIG. 2 can be utilized to install the lower completion, which may include one or more strings of production liner or production tubing (not shown) that span the completion zone and isolate the lower pressure rated outer casing strings from high pressure production fluids.

During the lower completion phase, the subsea wellhead 12, tubing head 46, MCD 26, EDP 28, High Pressure Riser 24, surface connector 45, and surface BOP stack 30 may form a primary barrier against blowouts. In some cases, the equipment forming the primary barrier should be designed according to standards for containing pressure at the subsea wellhead 12 at or above 15,000 psi.

Figure 3:
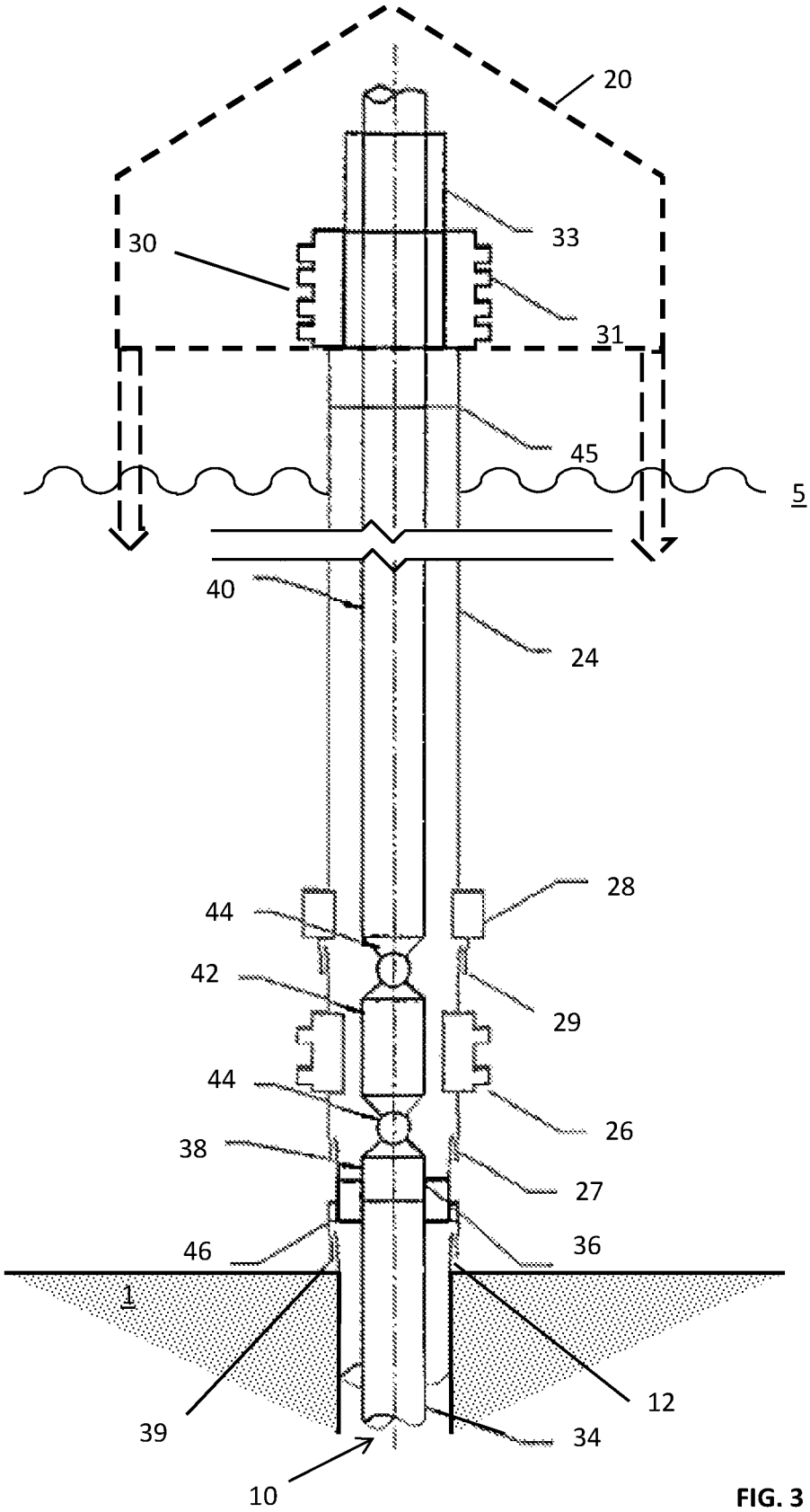
FIG. 3 is a partial schematic view of a surface BOP stack and a high pressure riser deployed on a subsea wellhead for upper completion operations.

Referring now to FIG. 3, the High Pressure Riser 24 and Surface BOP stack 30 of FIG. 2 are also used during the installation of the upper completion string. The upper completion string may contain various tubular members and equipment used to control the flow of formation fluids out of the wellbore. For example, the upper completion string may include tubing 34 that is supported in the wellbore by a tubing hanger 36. The tubing 34 may be run and set into place using a running tool 38 that is mounted to the end of a landing string 40 by a shear joint 42 and retainer valves 44.

During the upper completion phase, the upper completion string, including the tubing 34, running tool 38, shear joint 42, retainer valves 44, and landing string 40, as well as the surface ram BOP 31 may form a primary barrier against blowouts. In some cases, the equipment forming the primary barrier should be designed according to standards for containing pressure at sea surface 5 at or above 15,000 psi. In contrast with FIG. 2, the subsea wellhead 12, tubing head 46, MCD 26, EDP 28, High Pressure Riser 24, surface connector 45, and surface annular BOP 33 may form a secondary barrier against blowouts.

Thus, in the disclosed embodiments, well construction may be accomplished using a Conventional BOP stack and Conventional Riser during the drilling phase, and then a High Pressure Riser and Surface BOP stack are used during the completion phase. This allows a well to be drilled using a Conventional BOP stack and Conventional Riser and then completed with a Surface BOP stack and High Pressure Riser, which increases the safety and reliability of both phases of well construction.

Figure 4:
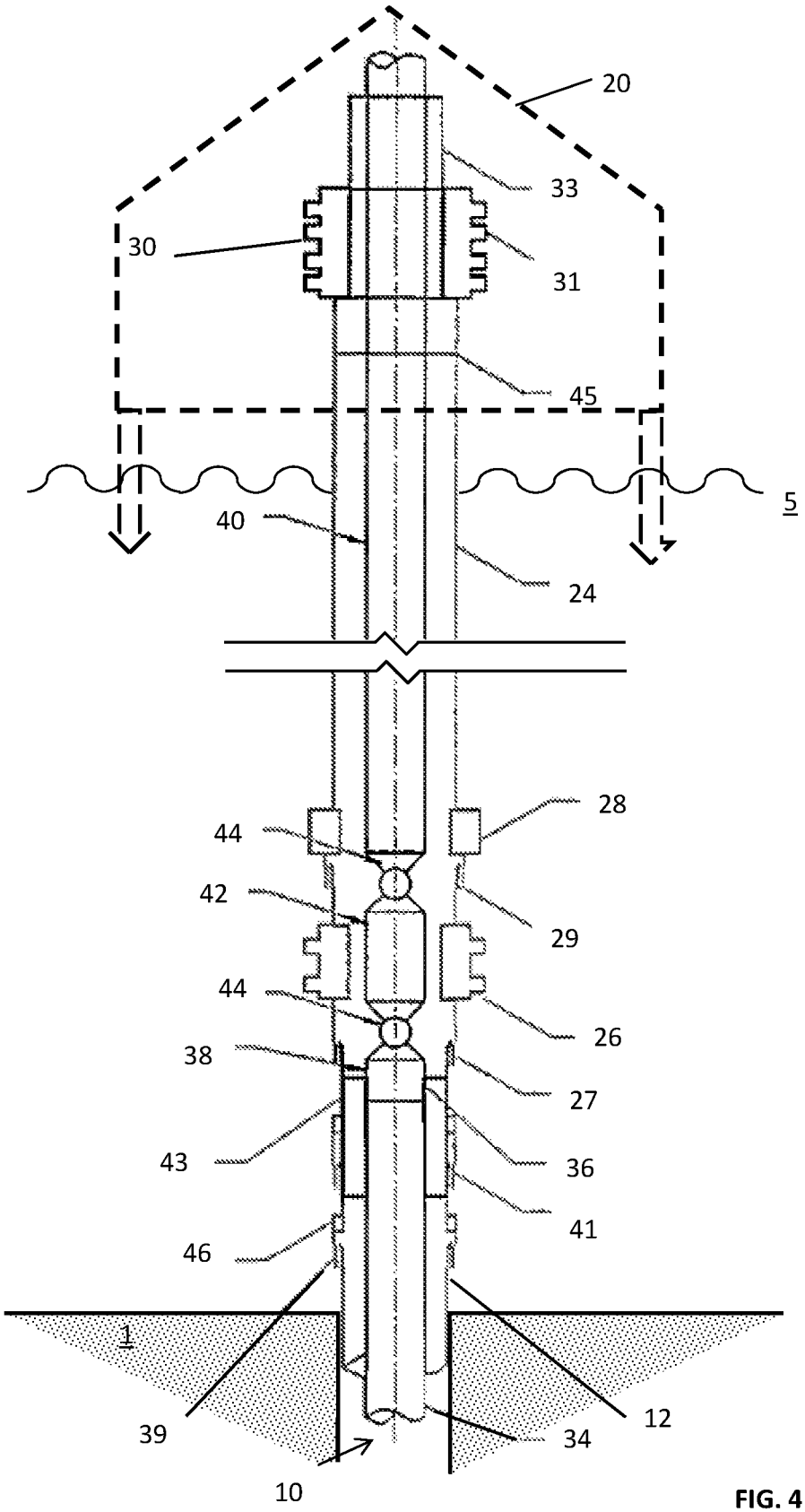
FIG. 4 is a partial schematic view of a surface BOP stack and a high pressure riser deployed on a subsea wellhead for workover or intervention operations.

In some embodiments, the well 10 can be completed using a subsea tree 43 after the construction phase, and may be put in production. The subsea tree 43 is connected on top of the tubing head 46 by tree connector 41. The subsea tree 43 forms a portion of the primary barrier. Similar to FIG. 3, FIG. 4 illustrates a High Pressure Riser 24 and a Surface BOP stack 30 configuration being used in workover or intervention operations with a well 10. The High Pressure Riser 24 is coupled to the subsea tree 43 by a mudline closure device (MCD) 26 and emergency disconnect package (EDP) 28. The EDP 28 is connected on top of the MCD 26 via EDP connector 29. The MCD 26 is connected on top of the subsea tree 43 via MCD connector 27.

During workover and intervention operations, like during the upper completion phase illustrated in FIG. 3, the subsea wellhead 12, tubing head 46, MCD 26, EDP 28, High Pressure Riser 24, surface connector 45, and surface annular BOP 33 may form a secondary barrier against blowouts. While the primary barrier during the workover and intervention operations is the landing string 40, the landing string 40 may be greatly simplified in view of the pressure rating on the High Pressure Riser 24. The inherent safety provided by the full pressure rating of the riser allows a reduction of the complexity of the landing string i.e. the dual redundant valves in the subsea test tree can be replaced with a simple shear joint.

Thus, in the disclosed embodiments, workover and intervention operations are accomplished using a High Pressure Riser and Surface BOP stack. The High Pressure Riser and Surface BOP stack are coupled to the subsea tree.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents, and alternatives falling within the scope of the claims.

What is claimed is:

1. A method for constructing and completing a well comprising:

coupling a conventional BOP stack to a subsea wellhead via a conventional riser;

drilling and casing a wellbore through the conventional BOP stack and conventional riser;

removing the conventional BOP stack from the subsea wellhead;

coupling a mudline closure device to the subsea wellhead, wherein the mudline closure device is rated for containing a pressure equal to 20,000 psi;

coupling a high pressure riser to the mudline closure device, wherein the high pressure riser is rated for containing a differential pressure equal to 15,000 psi;

coupling a surface BOP stack to the high pressure riser, wherein the surface BOP is rated for containing a pressure equal to 15,000 psi; and completing the well through the surface BOP stack, wherein completing the well is performed using a primary pressure barrier including a landing string coupled to a tubing hanger and a tubing, a secondary pressure barrier including the high pressure riser and the surface BOP stack, and without a subsea test tree.

2. A method for completing a well comprising:

removing a conventional BOP stack from a subsea wellhead after construction of a wellbore below the subsea wellhead;

coupling a mudline closure device to the subsea wellhead, wherein the mudline closure device is rated for containing a pressure equal to 20,000 psi;

coupling a high pressure riser to the mudline closure device, wherein the high pressure riser is rated for containing a pressure equal to 15,000 psi;

coupling a surface BOP stack to the high pressure riser, wherein the surface BOP is rated for containing a pressure equal to 15,000 psi; and completing the well through the surface BOP stack, wherein the surface BOP is rated for containing a pressure equal to 15,000 psi, wherein completing the well is performed using a primary pressure barrier including a landing string coupled to a tubing hanger and a tubing, a secondary pressure barrier including the high pressure riser and the surface BOP stack, and without a subsea test tree.

3. A method for workover or intervention operations with a well comprising:

coupling a mudline closure device to a subsea tree;

coupling a high pressure riser to the mudline closure device, wherein the mudline closure device is rated for containing a pressure equal to 20,000 psi;

coupling a surface BOP stack to the high pressure riser, wherein the high pressure riser is rated for containing a pressure equal to 15,000 psi; and performing the workover or intervention operations through the surface BOP stack, wherein the surface BOP is rated for containing a pressure equal to 15,000 psi, wherein the workover or intervention operations are performed using a primary pressure barrier including a landing string coupled to a tubing hanger and a tubing, a secondary pressure barrier including the high pressure riser and the surface BOP stack, and without dual redundant valves in a subsea test tree.

* * * * *